US006449906B1

(12) United States Patent
Jacobs

(10) Patent No.: US 6,449,906 B1
(45) Date of Patent: Sep. 17, 2002

(54) TOP GUIDE FOR SLIDING DOORS

(75) Inventor: Kenneth Jacobs, Surrey (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/704,827

(22) Filed: Nov. 3, 2000

Related U.S. Application Data

(60) Provisional application No. 60/163,572, filed on Nov. 5, 1999.

(51) Int. Cl.[7] ..... E05D 13/00
(52) U.S. Cl. ..... 49/409
(58) Field of Search ..... 49/409, 410, 425; 160/196.1, 199, 206; 16/92, 95 R, 97

(56) References Cited

U.S. PATENT DOCUMENTS

| | | | | |
|---|---|---|---|---|
| 2,117,606 A | | 5/1938 | French | |
| 2,668,317 A | | 2/1954 | Le Bon, III | |
| 3,688,340 A | | 9/1972 | Schoenbrod | |
| 3,722,028 A | | 3/1973 | Schoenbrod | |
| 4,014,071 A | | 3/1977 | Janson | |
| 4,102,007 A | | 7/1978 | Janson | |
| 4,134,176 A | | 1/1979 | Janson | |
| 4,166,306 A | | 9/1979 | Janson | |
| 4,285,095 A | | 8/1981 | Janson | |
| 4,653,127 A | * | 3/1987 | Baus | 49/409 |
| 5,349,783 A | | 9/1994 | Jasperson et al. | |
| 5,724,770 A | * | 3/1998 | McAfee | 49/409 |
| 5,845,363 A | | 12/1998 | Brempell et al. | |
| 5,927,017 A | | 7/1999 | Jacobs et al. | |
| 5,974,738 A | | 11/1999 | Jacobs | |
| 6,058,656 A | * | 5/2000 | Bischof et al. | 49/409 |

FOREIGN PATENT DOCUMENTS

| | | | | |
|---|---|---|---|---|
| EP | 413881 | * | 2/1991 | 49/409 |
| GB | 496072 | | 11/1938 | |
| GB | 2 171 135 A | | 8/1986 | |
| GB | 2 338 018 A | | 12/1999 | |
| JP | 405239972 | * | 9/1993 | 49/409 |

OTHER PUBLICATIONS

A copy of Search Report from corresponding UK Application No. GB 0026915.9.

* cited by examiner

*Primary Examiner*—Jerry Redman
(74) *Attorney, Agent, or Firm*—Pillsbury Winthrop LLP

(57) ABSTRACT

A top guide is disclosed for mounting an upper portion of a door panel assembly with respect to track. The top guide includes an integrally molded plastic mounting structure having connecting portions constructed and arranged to enable the mounting structure to be connected to a door panel assembly. The mounting structure also includes first and second roller mounting portions. First and second rollers are mounted for rotation on the first and second roller mounting portions. The first roller mounting portion is formed on a portion of the integrally molded plastic mounting structure which is resiliently biased to enable the first roller mounted thereon to be in biased engagement with one of the track surfaces when the top guide is mounted with respect to the track.

11 Claims, 8 Drawing Sheets

TOP GUIDE FOR SLIDING DOORS

CROSS REFERENCE TO RELATED APPLICATION

This application relates to and claims priority on U.S. Provisional Application No. 60/163,572, filed on Nov. 5, 1999, which is incorporated by reference herein.

FIELD OF THE INVENTION

The present invention relates generally to sliding doors, and more specifically relates to a top guide for sliding doors.

BACKGROUND OF THE INVENTION

Sliding panel doors, such as those used in closets, are constructed from thin panels that gain rigidity from the application of a perimeter frame formed by two side, one top, and one bottom roll formed or extruded metal sections that are mechanically joined at each corner by means of a metal or plastic joining plate. The weight of the panel door is typically supported by a bottom track, and the door is provided with wheels or other slidable elements that can slide or roll within the bottom track. The top portion of the door is often retained and guided in a top "E" section track which provides downwardly depending leg portions defining vertical surfaces in which the upper portion of the panel door is retained and guided. Particularly, the upper portion of the panel door is typically provided by a top roller guide assembly that is attached to the metal or plastic frame joining plate at each top corner of the door. The top roller guide assembly typically includes a pair of wheels each rotatable about a vertical axis. As the door travels along the lower and upper tracks, the upper roller guide rollers or wheels rotate against the inside parallel vertical edges of the E track and maintain a door positioned centrally within the track cavity.

To accommodate tolerance variation in the width of the track section between the vertical parallel track surfaces, one or more of the two wheels is typically retained on an outwardly spring biased axle to produce a snug fit and eliminate transverse movement and rattle of the door with respect to the track. Typically, the top roller guide assembly is formed from several components, such as a metal or plastic bracket, and a spring bias axle assembly which is a separate component mounted to the bracket. In addition, other attachments are provided for connecting the top guide to the door assembly.

SUMMARY AND OBJECTS OF THE INVENTION

It is an object of the present invention to provide a top guide assembly having a simpler and more cost effective construction. Accordingly, the present invention provides a top guide for mounting an upper portion of door panel assembly with respect to a track providing vertically disposed opposing parallel track surface. The top guide comprises an integrally molded plastic mounting structure. The mounting structure includes connecting portions constructed and arranged to enable the mounting structure to be connected to a door panel assembly. The mounting structure further comprises first and second roller mounting portions. In addition, first and second rollers are mounted for rotation on the first and second roller mounting portions, respectively, the first roller mounting portion being formed on a portion of the integrally molded plastic mounting structure which is resiliently biased to enable the first roller mounted thereon to be in biased engagement with one of the track surfaces when the top guide is mounted with respect to the track. The resiliently biased portion of the integrally molded plastic mounting structure is resiliently biased from the resiliency of the molded plastic from which the mounting structure is molded.

A further object of the present invention is to provide a sliding door assembly for mounting on a track assembly that incorporates a top guide as set forth above.

It is a further object of the present invention to provide an entire sliding door assembly, including the door assembly, the upper and lower tracks for mounting the door assembly, and top guides mounted on the upper portion of the door assembly for cooperation with the upper track to mount the upper portion of the door assembly in slidable relation with respect to the upper track. The top guides are constructed as set forth above.

Other objects, advantages, and features of the present invention will be appreciated from the following detailed description, drawings, and claims.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENTS

Figure 1:
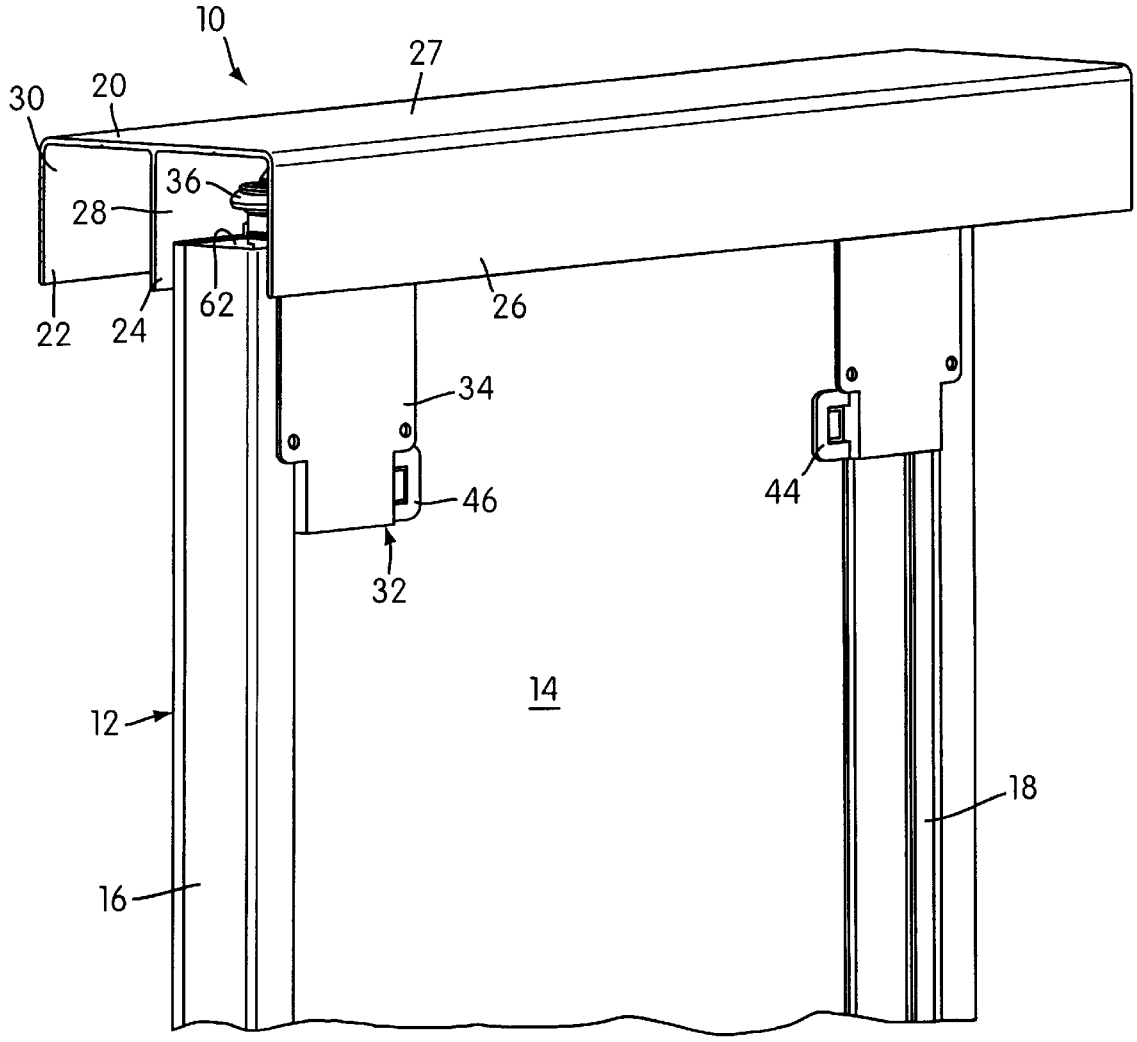
FIG. 1 is a schematic view of the right and rear side of a sliding door assembly in accordance with the present invention.
Figure 13:
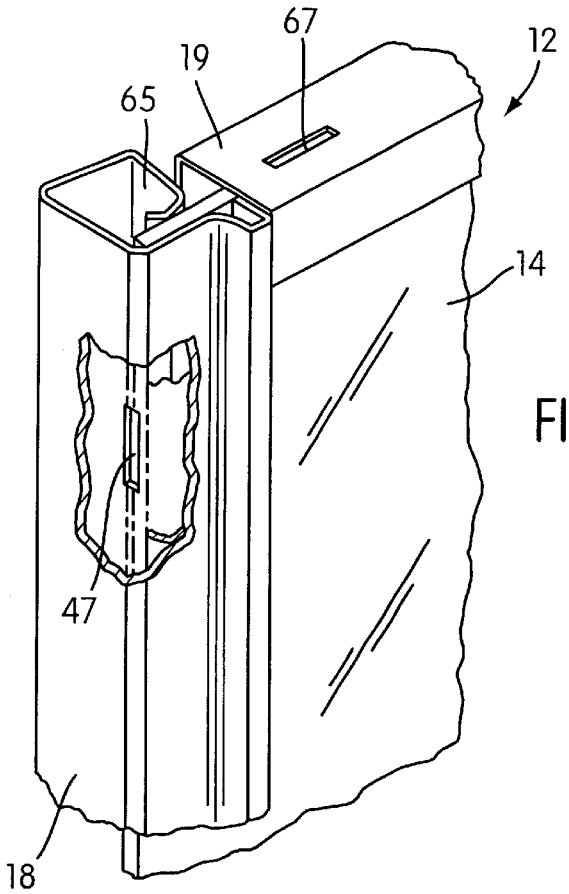
FIG. 13 is a schematic view of an upper left hand corner of the front side of the door panel assembly in accordance with the present invention.
Figure 14:
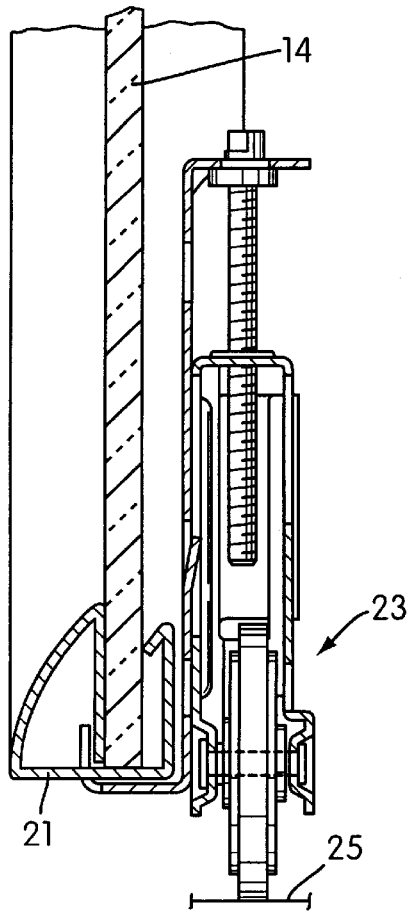
FIG. 14 is a schematic view of a lower portion of the lower door panel frame extending horizontally along the lower edge of the door panel in accordance with the present invention.

FIG. 1 is an isometric view looking downwardly at a right and rear side of a sliding door assembly, generally indicated at 10, in accordance with the principals of the present invention. The sliding door assembly 10 includes a door panel assembly 12 including a main door panel 14, a first side frame member 16, and an opposite side frame member 18. As shown in FIG. 13, which is an isometric view of the upper left hand corner of the front side of the door panel assembly 12, it can be appreciated that the sliding door assembly 10 further includes an upper horizontal frame member 19 along the top edge of the door panel 14, and as shown in the cross section of FIG. 14, also includes a lower door panel frame 21 extending horizontally along the lower edge of the door panel 14. Mounted on the lower horizontal frame is a roller assembly 23 that mounts the door assembly 12 on a lower track 25 on which the weight of the door assembly 12 is supported. The portions illustrated in FIGS. 13 and 14 can be more fully appreciated from commonly assigned U.S. Pat. Nos. 5,673,516 and 5,349,783, both of which are hereby incorporated by reference into the present application in their entirety for all material disclosed therein.

As further illustrated in FIG. 1, the sliding door assembly 10 includes an upper "E" section track 20. The track 20 has three downwardly depending flanges 22, 24, and 26. Flanges 24 and 26 define a channel 28 therebetween which receives the door panel assembly 12. Flanges 22, 24 and 26 are interconnected by an upper web portion 27. It can be appreciated that a second door panel assembly and top guide (not shown) can be received in a channel 30 between flanges 22 and 24.

The sliding door assembly 10 further includes a corner connector top guide 32 manufactured in accordance with the principals of the present invention. The top guide 32 is mounted on an upper portion of the door assembly 12. As can be appreciated from FIGS. 1 and 2, the top guide 32 includes a mounting structure 34 for being mounted to the door panel assembly 12, and first and second rollers 36, 38 which are mounted for rotational movement on the mounting structure. As shown best in FIG. 2, the flanges 24 and 26 define vertically disposed opposing parallel track surfaces 40 and 42 respectively. The mounting structure 34 of the top guide 32 mounts the rollers 36, 38 of the top guide 32 in rolling engagement with respect to the upper track 20.

Figure 3:
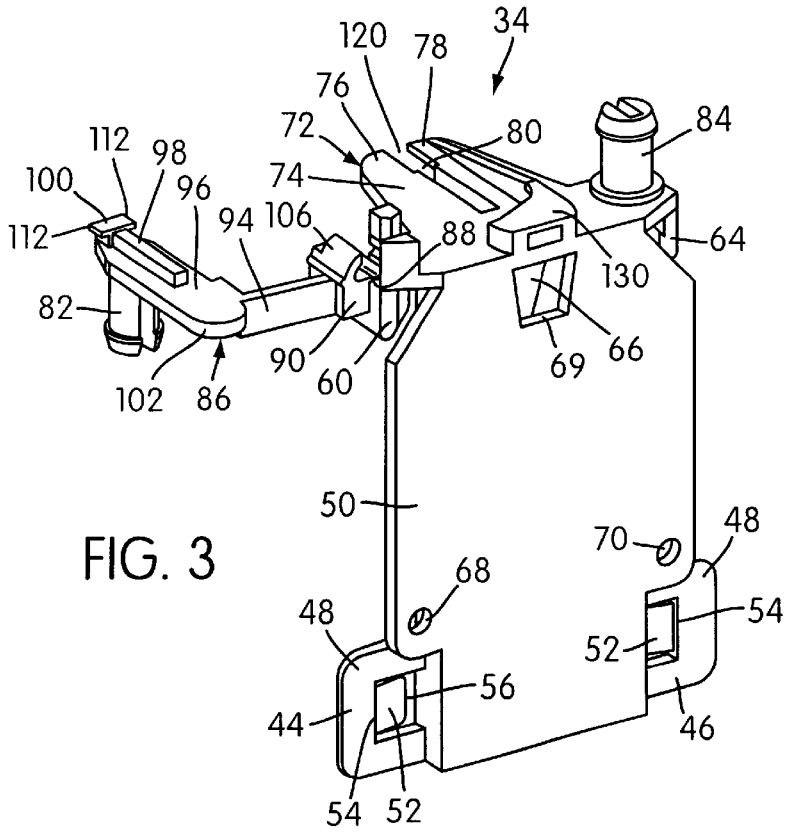
FIG. 3 is a front schematic view of a mounting structure for the sliding door assembly in accordance with the present invention.

Turning now to FIG. 3, there is shown an isometric view looking at the front, top, and left side of the mounting structure 34 in accordance with the principals of the present invention. In accordance with the invention, the entire mounting structure 34 is manufactured from a single injection molded plastic material. Any suitable plastic material can be used. The mounting structure includes connecting portions that enable the mounting structure 34 to be connected to the door panel assembly 12. In the preferred embodiment, the connecting portions include at least one laterally outwardly projecting tab 44 constructed and arranged to be received in a slot disposed in one of the first and second side frame members 16. In the embodiment shown, the mounting structure 34 is provided with a pair of tabs 44, 46 to enable the same mounting structure 34 to be connected to either the first side frame member 16 by use of the tab 44 or to the opposite side frame member 18 by use of the tab 46, as can be appreciated by FIG. 1. When the tab 46 is used to connect a mounting structure 34 to the side frame 18, it is inserted in slot 47 illustrated in FIG. 13. The side frame 18 has a similar slot 47 (not shown) for receiving tab 44.

Each tab is provided with substantially U-shaped portion 48 inwardly formed with a main body portion 50 of the mounting structure 34. Between the legs of the U-shaped portion 48 is an angled prong portion 52 integrally formed at edges 52 and 54 thereof to the bight portion of the U-shaped portion 48. Each prong portion 52 is angled such that as the U-shaped portion 48 of the associated tab is inserted into the slot 47 in the associated side frame member, the prong portion 52 is flexed inwardly so as to become in more parallel alignment with the U-shaped portion 48, until the trailing edge 56 of the prong portion 52 passes beyond the edges defining the slot 47 of the associated slide frame member, whereupon the prong portion is permitted to spring back outwardly under the resiliency of the plastic material forming the prong portion 52 to lock the mounting structure to the associated side frame members.

In addition, to this tab arrangement, the connecting portions of the mounting structure further include a downwardly projecting tab 60 constructed and arranged to be received in the open upper end 62 (see FIG. 1) of the first side frame member 16. As noted previously, the mounting structure 34 can also be connected with the opposite side frame member 18 by use of basically the same type of downwardly extending projection 64 on the opposite side of the mounting structure. The annually projecting portion 64 constitutes a side frame engaging portion that can be received in the open upper end 65 of the side frame member 18 (see FIG. 13).

The connecting portions may also be considered to include centrally disposed downwardly depending upper horizontal frame engaging portion 66 which is constructed and arranged to engage into an upwardly facing slot 67 in the upper horizontal frame member 19 of the door panel assembly 12. A hole or opening 69 is provided in the planar body portion 50, which has no functional purpose in the operation of the top guide 32, but is simply a by product of molding the frame engaging portion 66.

The aforementioned connecting portions are preferred only, and it should be appreciated that any conventional means for connecting a top guide the upper portion of a door or door panel assembly can be used. It should also be appreciated that the connecting portions discussed above are all integrally formed from the single injection molded part comprising the mounting structure 34.

In the event that the mounting structure 34 is to be mounted on a non-standardized door panel assembly such that no slots are provided for receiving tabs 42 and/or 46, it can be appreciated that these tabs 44, 46 can be snapped off the main body portion 50. In this case, holes 68 and 70 are provided in the body portion 50 for receiving fasteners that can be used to mount the flat planar body portion 50 to a door panel or door panel assembly.

Mounting structure 34 further comprises a top portion 72. Preferably, the top portion 72 includes a planar portion 74 forming a right angle and with the body portion 50 and extending essentially perpendicular with the planar body portion 50. The planar portion 74 is constructed and arranged to be disposed in overlying relation with the respect to the upper horizontal frame member 19 of the door panel assembly 12. The planar portion 74 is split into two prong portions 76 and 78 as shown, with a slot 80 defined therebetween. The slot 80 extends in a direction generally transverse to the frame of the door panel 14 and transverse with respect to the track surfaces 40 and 42. This transverse slot is preferably perpendicular with respect to the aforementioned track surfaces 40 and 42.

The mounting structure 34 further includes a first roller or mounting portion 82 and a second roller mounting portion 84. The roller mounting portions 82, 84 are preferably molded onto the top portion 72. Each of the roller mounting portions 82, and 84 are constructed and arranged to rotatably mount associated rollers 36, 38. While the rollers 36, 38 can be of any rollable instruction, it is preferred that these members be in the form of wheels and that the mounting portions 82, 84 formed the axles for such wheels.

In the illustration in FIG. 3, as will be more fully appreciated with the description of FIGS. 9–12, the first roller mounting portion 82 is mounted on a portion 86 of the integrally molded plastic mounting structure 34 which can be resiliently biased to enable the first roller 36 mounted thereon to be biased into engagement with track surface 40 when the top guide 82 is mounted with the respect to the track 20. The portion 86 is hingedly connected to other portions of the mounting structure 34 by a living hinge 88. In the embodiment shown, the living hinge 88 is disposed between the portion 86 and an upper portion of the downwardly depending tab or projection 60 as shown.

The resilient portion 86 can be considered to be an arm integrally connected at one end 90 thereof to an arm supporting portion 92 of the mounting structure 34. It should be appreciated that this arm supporting portion 92 need not be disposed at the upper portion of the downwardly depending tab or projection 60, but can be disposed anywhere on the mounting structure 34 that would enable the resilient portion 86 to accomplish its function of resiliently biasing the first roller mounting portion 82 into one of the vertical track sidewalls 40. It should also be appreciated that in the preferred embodiment shown, the arm or resilient portion 86 is connected to the arm supporting portion 92 by the living hinge 88, but that the function of the resilient portion 86 can be accomplished with alternate constructions not requiring a living hinge. The living hinge 88 is provided primarily to facilitate manufacturing and subsequent manipulation of the mounting structure 34 into operative form as will be described.

In the preferred embodiment shown, the resilient portion or arm 86 forms a substantially L shaped configuration including a first leg 94 and a second leg 96. The second leg 96 carries an elongated rib 98 on a side of the leg 96 opposite the first roller mounting portion 82. At one end of the ridge or rib 98, there is disposed a laterally outwardly extending, "T" shaped slot retaining portion 100. The opposite end of leg 96 terminates in an arcuate or rounded edge portion 102 as shown.

The other leg portion 94 of the resilient portion 86 is provided with an upwardly extending arcuate protrusion 106. The convex arcuate surface of the protrusion 106 is provided with a small projection 108 towards the trailing end of the arcuate protrusion 106. The downwardly extending tab or projection 60 is provided with an upwardly facing arcuate recess 110 constructed and arranged to receive the arcuate protrusion 106 when the resilient portion 86 is pivoted about the living hinge 88. A groove 111 disposed in the recess 110 and is constructed and arranged to receive the projection 108 so as to facilitate locking of the arm or resilient portion 86 when it is in a folded condition.

Figure 4:
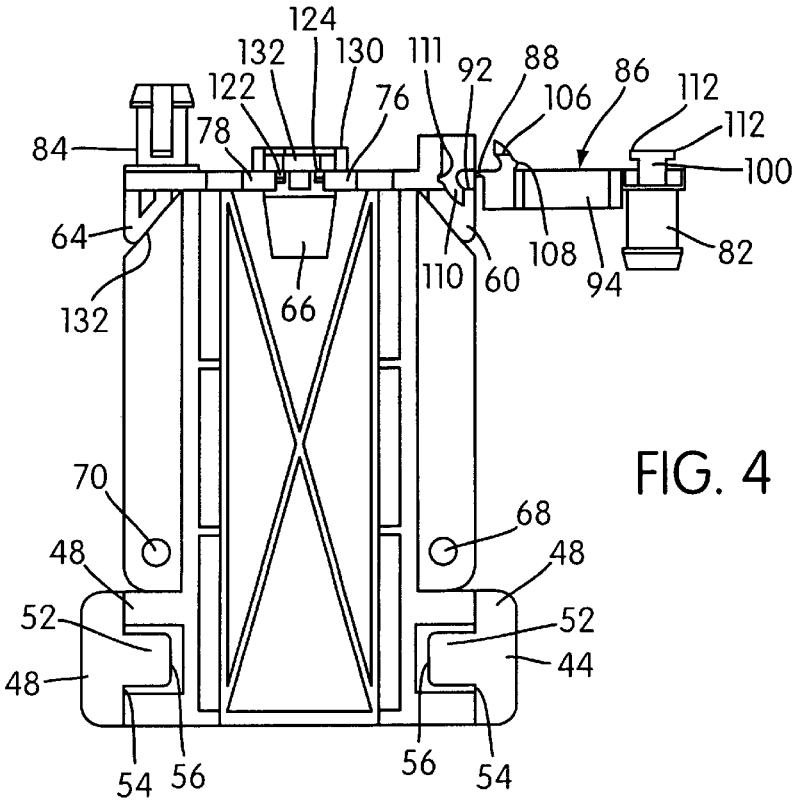
FIG. 4 is a rear view of the mounting structure of FIG. 3.
Figure 5:
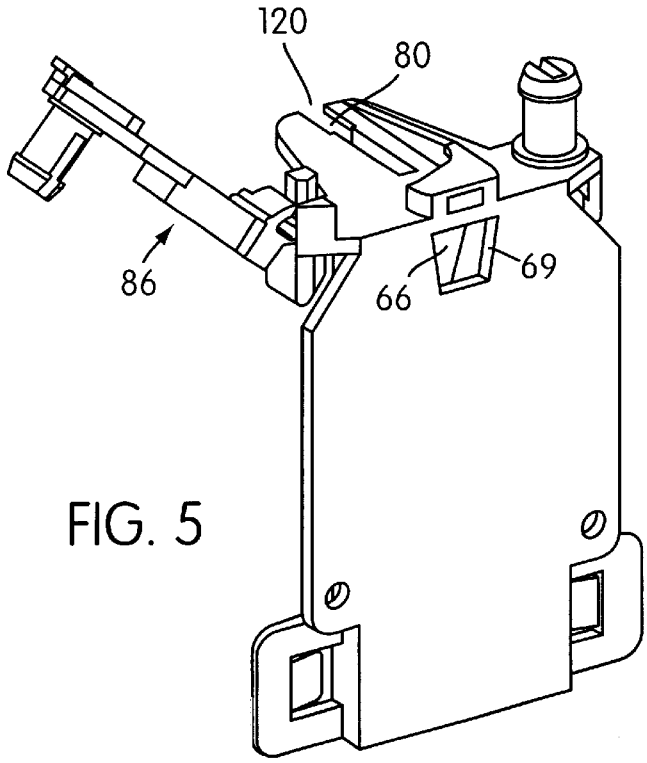
FIGS. 5, 7, 9, and 11 are front schematic views of the mounting structure of FIG. 3 illustrating the various stages of manipulation of the top guide assembly into its operative form.
Figure 6:
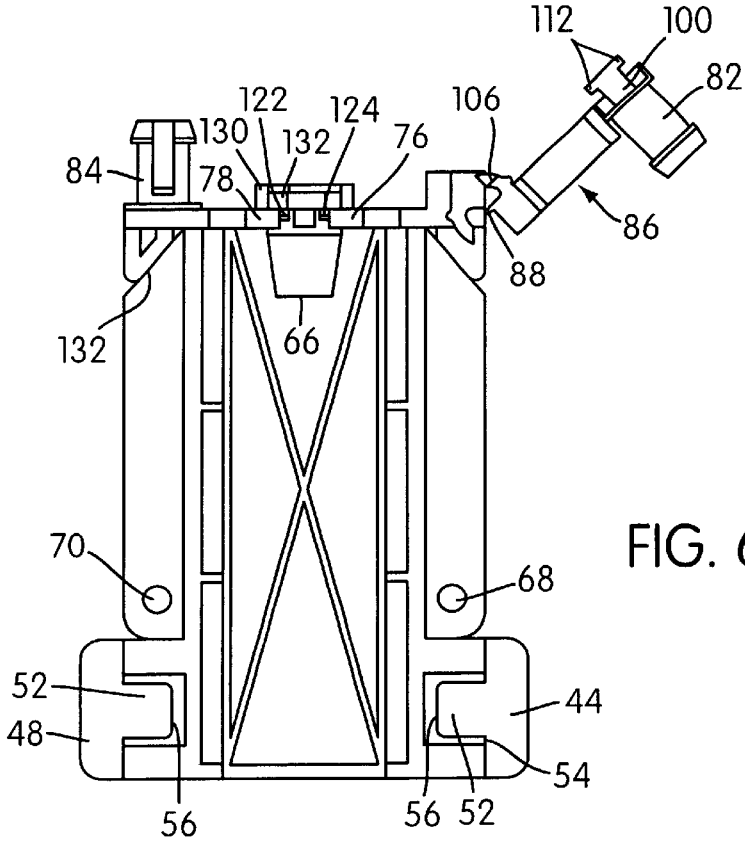
FIGS. 6, 8, 10, and 12 are rear schematic views corresponding to the views in FIGS. 5, 7, 9 and 11 showing the progression of manipulation of the top guide mounting structure into its operative configuration from a rearward position.
Figure 7:
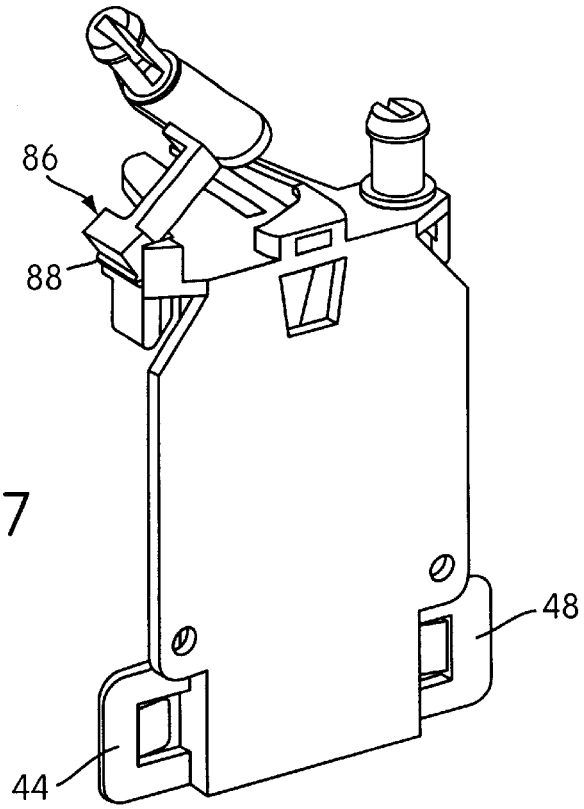
Figure 8:
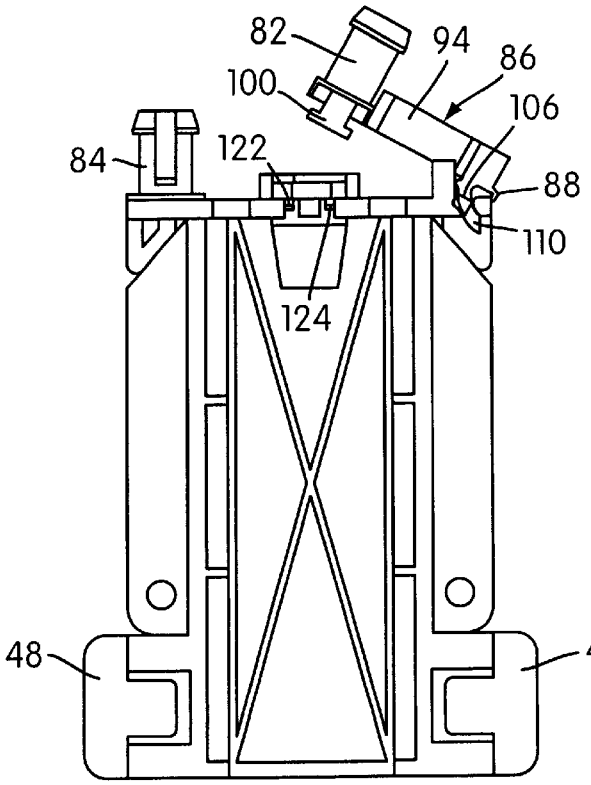
Figure 9:
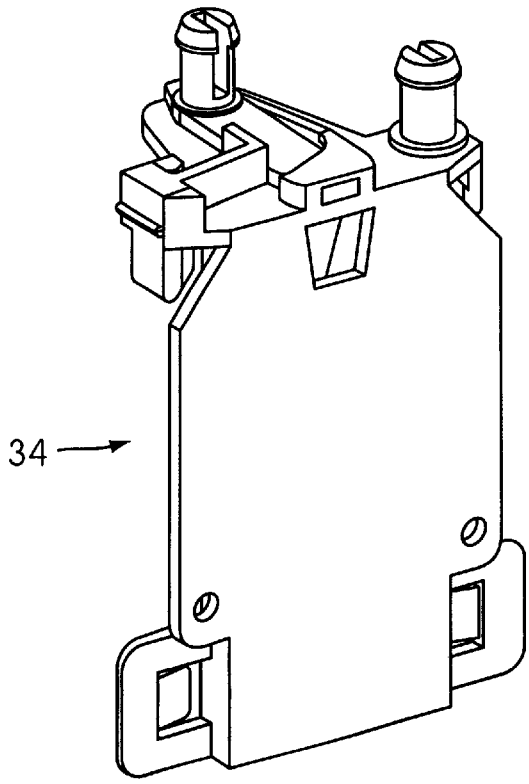

When the mounting structure 34 is removed from the injection molding apparatus, the mounting structure 34 assumes the configuration illustrated in FIGS. 3 and 4. In order to assemble the top guide into a form in which it is operative, reference will be made to FIGS. 6–11. FIGS. 5, 7, 9, and 11 are isometric views similar to FIG. 3, but showing the various stages of manipulation of the top guide assembly 32 into its operative form. FIGS. 6, 8, 10, and 12 are rear elevational views similar to FIG. 4, but showing the progression of manipulation of the top guide mounting structure into its operative configuration and corresponding to the positions illustrated in FIGS. 5, 7, 9, and 11, respectively.

As can be appreciated, from FIGS. 5–8, the resiliently biased portion 86 can be manually or automatically pivoted about the living hinge 88. As can be best appreciated from FIG. 8, as a result of the pivoting motion, the arcuate protrusion 106 is received within the recess 110. When the resilient portion 86 reaches the position illustrated in FIGS. 7 and 8, or prior thereto, in addition to the pivoting action of the resiliently biased portion 86 in a swing plane which is essentially parallel to the body portion 50, the operator simultaneously manually forces the resiliently biased portion 86 forwardly so that the slot retaining portion 100 is moved away from the body portion 50 and towards the opening or mouth 120 of the slot 80. This is accomplished by a slight bending or flexing action in the plastic material forming the leg 94. This flexing action will enable the T-shaped slot retaining portion 100 to have the laterally outwardly extending portions 112 thereof to slide beneath reduced thickness portions 122 and 124 of the prong portions 78 and 76, respectively.

Figure 10:
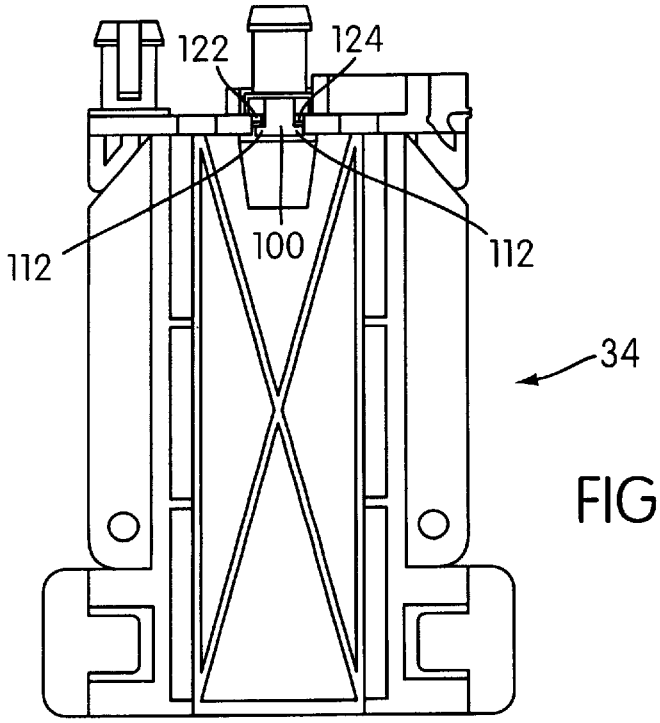

The counteracting flexing forces of the leg 94 subsequently pull the slot retaining portion 100 slightly towards the body portion 50 after the resilient portion 86 is released, and the outwardly extending flanges 112 of the slot retaining portion 100 are thus retained beneath the narrowed width retaining portions 122, 124 as best illustrated in FIG. 10.

It should also be appreciated that mounted on the upper portion 72 is a forwardly facing receptacle portion 130. The receptacle portion 130 has a forwardly facing recess 132 constructed and arranged to receive the rounded edge portion 102 when the flexing action of leg 94, of resiliently biased portion 86 moves the portion 86 back to its neutral condition after the slot retaining portion flanges 112 are slid beneath the retaining portions 122, 124. The recess 132 in conjunction with the rounded edge portion 102 further retain resilient portion 86 in its folded condition illustrated in FIGS. 9–12.

From the above, it can be appreciated that the resilient portion 86 is retained in the folded condition by the slot retaining portion flanges 112 received beneath the retaining portions 122, 124, the rearward arcuate portion 102 of the leg portion 96 being received in the recess 132 of the receptacle 130, and the projection 108 received in the groove 111.

In the folded condition, the resilient portion 86 and particularly the leg portion 94 thereof is capable of slight resilient movement in the longitudinal direction of groove or slot 80. The lateral movement of the resilient portion 86 is limited to this generally linear movement as a result of the rib 98 being received within the slot 80. Specifically, the slide surfaces of the rib 98 ride between the facing surfaces on opposite sides of the slot 80 to restrict movement of the first roll or mounting portion 82 mounted on the resilient portion 86 to substantially linear movement and the longitudinal or axial direction defined by the rib 98 and slot 80. The rib 98 and the slot 80 can thus be considered to be a linear guide track. This linear movement is transverse (preferably perpendicular) to the parallel track surfaces 40, 42 when the top guide 32 is mounted with respect to the top track 20.

Figure 11:
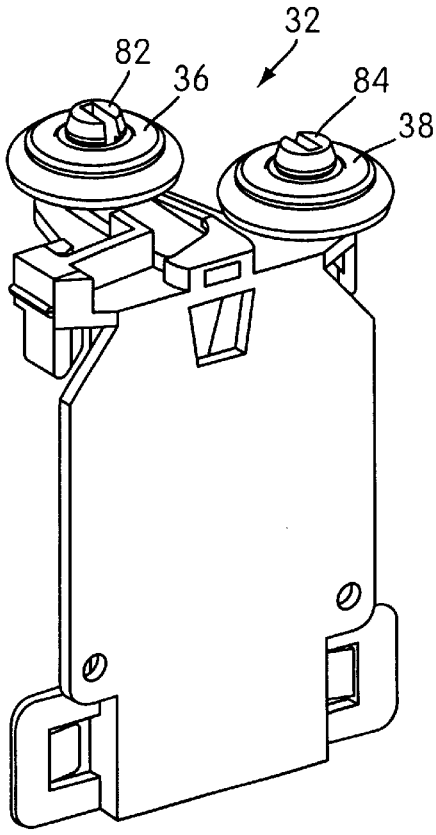
Figure 12:
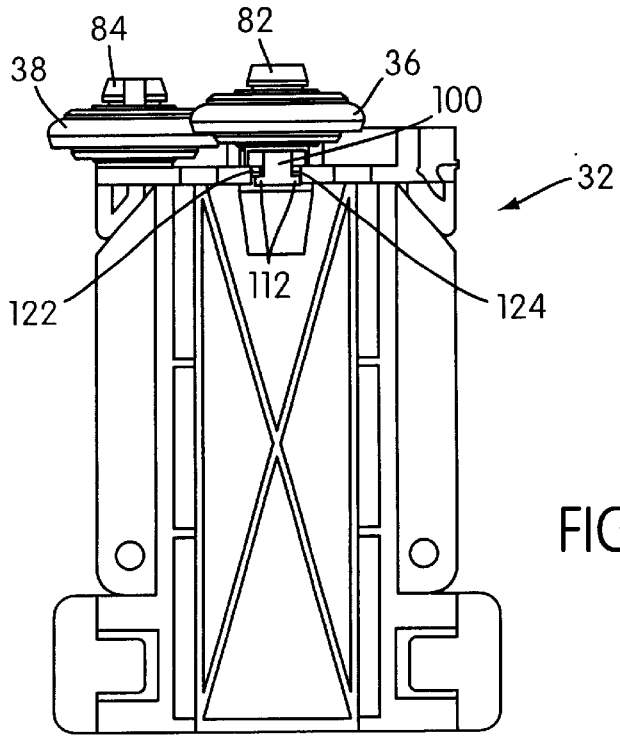

As shown in FIGS. 11 and 12, the rollers 36 and 38 have been snapped in place over the roller mounting portions 82, 84 respectively. In this regard, the upper ends of the roll portions 82 and 84 are provided with frustoconical surfaces, but are split to enable spaced portions thereof to be biased slightly inwardly to enable the rollers to slide downwardly on the sloped surfaces beyond the trailing edge of the sloped surfaces, whereupon the spring bias of the plastic material enables the split portions to snap outwardly and retain the rollers in place.

Once assembled in the condition illustrated in FIGS. 11 and 12, the top guide 32 can be mounted on the door panel assembly 12. This is accomplished, for example, by inserting the outwardly depending tab or projection 64 into the upper end 65 of the side frame member 18 illustrated in FIG. 13. This insertion is accomplished by having the sloped surface 132 of the projection 64 disposed essentially vertically, so that the top guide 32 is disposed at an angle with the respect to the side frame 18. The top guide 32 is then pivoted so that the tab 46 is inserted into the slot 47 in the side frame member 18, and so that the downwardly depending projection 66 is received in the slot 67 in the upper frame member 19. After the trailing edge 56 of the prong portion 52 moves past the edge surrounding the slot 47, the prong projection 52 snaps outwardly to retain the tab 46 in place.

With the corner connector/top guide thus mounted in place, the upper portion of the door panel assembly 12 can now be slid into channel 28. When the upper portion of the door panel assembly is disposed within the channel 28, the roller 36 is flexed slightly rearwardly towards the body portion 50 for a distance of approximately 1.9–2.1 millimeters. Thus, the resilient portion 86 applies a resilient biasing force as a result of the resiliency of the molded plastic from which the mounting structure 34 is molded. The force is applied through the roller 36 and against the track surface 40. Hence, it can be appreciated by those skilled in the art that an equal and opposite force is applied by the roller 38 to the vertical track surface 42. This effectively accommodates tolerance variations in the track and reduces rattle and noise of the door as a result of the resiliently biased action of the rollers 36, 38.

In the preferred embodiment, after the top guide 32 is inserted into the channel 28, roller 36 can move approximately an additional 1.9–2.1 millimeters toward the track surface 42 against the biasing action of the resilient portion 86. This will accommodate constructions in which the distance between the flanges 24 and 26 is slightly narrower than the specification. After this additional movement, further movement will be prevented as a result of the rounded edge portion 102 engaging the surfaces of the receptacle 130 defining the recess 132.

Figure 2:
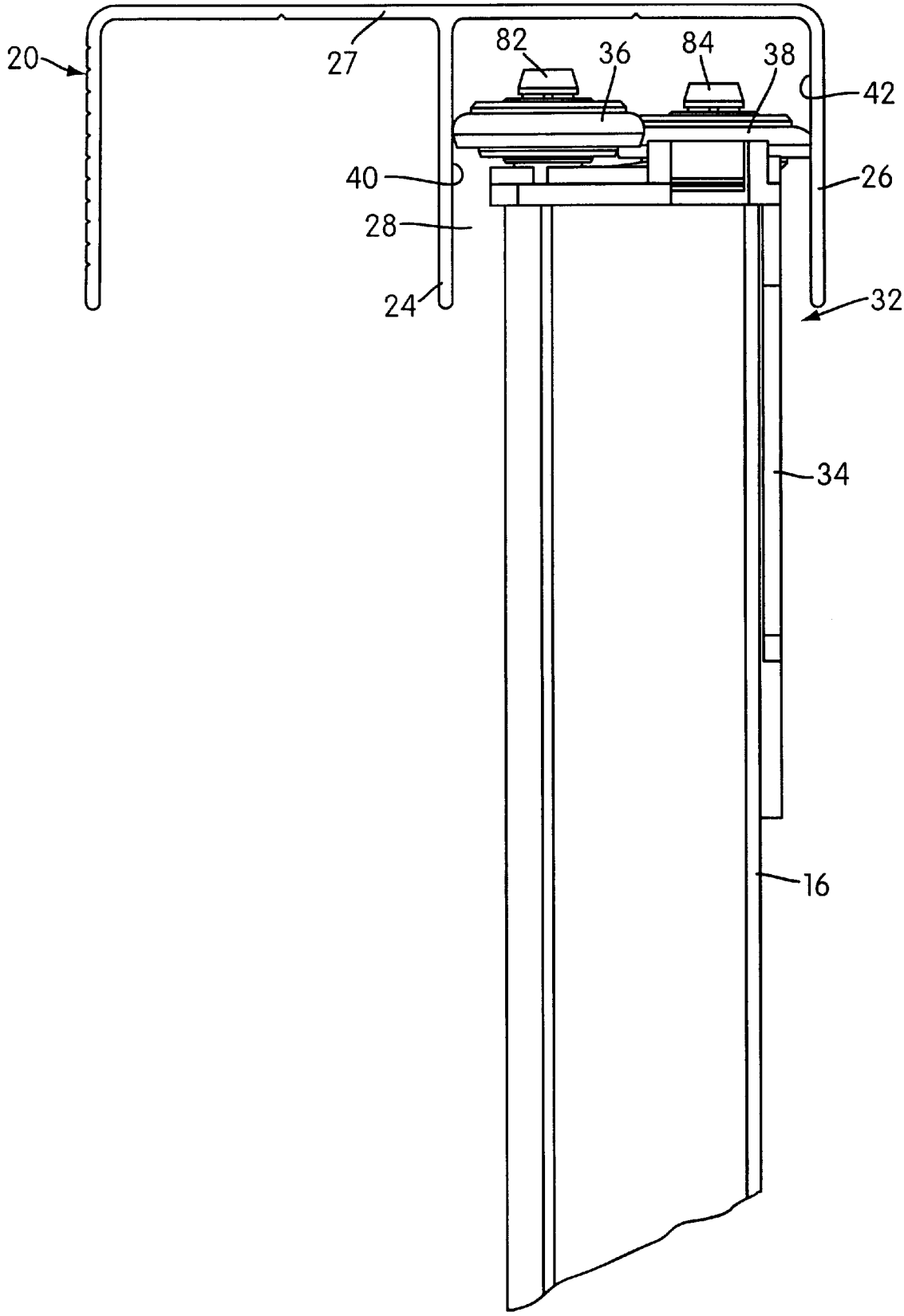
FIG. 2 is a side end view of the slide door assembly of FIG. 1.

From the above, it can be appreciated that the total amount of track tolerance variation that is accommodated by the construction is approximately 3.8–4.2 millimeters, and that in the operative condition illustrated in FIG. 2, the roller 36 is normally biased into a position which is approximately midway between the full range of accommodation, so that the top guide 32 can accommodate approximately 1.9–2.1 millimeters of tolerance variation between the flanges 24, 26 in either direction.

The foregoing description is for illustrative purposes only. It can thus be appreciated by those skilled in the art that other similar structures are intended to be covered by the present application. Thus, the present invention is intended to encompass all embodiments and equivalents which fall within the spirit and scope of the following claims.

What is claimed is:

1. A top guide for mounting an upper portion of a door panel assembly with respect to a track providing vertically disposed opposing parallel track surfaces, said top guide comprising:

an integrally molded plastic mounting structure, said mounting structure including connecting portions constructed and arranged to enable said mounting structure to be connected to a door panel assembly, said mounting structure further comprising first and second roller mounting portions;

first and second rollers mounted for rotation on said first and second roller mounting portions, respectively, said first roller mounting portion being formed on a portion of said integrally molded plastic mounting structure which is resiliently biased to enable said first roller mounted thereon to be in biased engagement with one of said track surfaces when said top guide is mounted with respect to said track, said portion of said integrally molded plastic mounting structure including a living hinge, said resiliently biased portion of said integrally molded plastic mounting structure being resiliently biased from the resiliency of the plastic material from which said mounting structure is molded.

2. A top guide according to claim 1, wherein said resiliently biased portion comprises a resilient arm integrally connected at one end thereof to an arm supporting portion of said mounting structure, and wherein said first roller mounting portion is integrally formed on said arm at a position spaced from said connected end.

3. A top guide according to claim 2, wherein said arm is integrally connected to said arm supporting portion by a living hinge.

4. A top guide according to claim 2, wherein said mounting structure further comprises a guide track extending transversely between said track surfaces when said top guide is mounted with respect to said track, wherein resilient biased movement of said first roller into engagement with one of said track surfaces is limited to movement defined by said guide track.

5. A top guide according to claim 4, wherein said guide track comprises linear surface portions formed in said mounting structure, and wherein said arm comprises cooperative surfaces engageable with said linear surface portions to guide said resilient biased movement of said first roller.

6. A top guide according to claim 5, wherein said arm comprises an L-shaped member integrally connected to said arm supporting portion by a living hinge, said L-shaped member being foldable at said living hinge such that said L-shaped member has a resilient leg member that travels generally along a plane until it engages a stop portion defining said guide track, said cooperative surfaces of said arm being brought into cooperative engagement with said linear surfaces of said guide track when said leg member engages said stop portion, said guide track limiting resilient biased movement of said first roller to a direction transverse to said plane.

7. A sliding door assembly for mounting on a track assembly, including an upper track providing vertically disposed opposing parallel track surfaces, said sliding door comprising:

a door panel assembly;

a top guide mounted on an upper portion of said door panel assembly, said top guide comprising:

an integrally molded plastic mounting structure, said mounting structure including connecting portions constructed and arranged to enable said mounting structure to be connected to a door panel assembly, said mounting structure further comprising first and second roller mounting portions;

first and second rollers mounted for rotation on said first and second roller mounting portions, respectively, said first roller mounting portion being formed on a portion of said integrally molded plastic mounting structure which is resiliently biased to enable said first roller mounted thereon to be in biased engagement with one of said track surfaces when said top guide is mounted with respect to said track, said portion of said integrally molded plastic mounting structure including a living hinge, said resiliently biased portion of said integrally molded plastic mounting structure being resiliently biased from the resiliency of the plastic material from which said mounting structure is molded.

8. A sliding door assembly, comprising:

a door panel assembly;

upper and lower tracks, said lower track substantially supporting the weight of said door panel assembly, said door panel assembly being slidably mounted on said lower track, said upper track providing vertically disposed opposing parallel track surfaces;

a pair of top guides mounted on upper corner portions of said door panel assembly and cooperable with said upper track to mount said upper portion of said door assembly in rolling engagement with respect to said upper track, said top guides each comprising:

an integrally molded plastic mounting structure, said mounting structure including connecting portions constructed and arranged to enable said mounting structure to be connected to a door panel assembly, said mounting structure further comprising first and second roller mounting portions;

first and second rollers mounted for rotation on said first and second roller mounting portions, respectively, said first roller mounting portion being formed on a portion of said integrally molded plastic mounting structure which is resiliently biased to enable said first roller mounted thereon to be in biased engagement with one of said track surfaces when said top guide is mounted with respect to said track, said portion of said integrally molded plastic mounting structure including a living hinge, said resiliently biased portion of said integrally molded plastic mounting structure being resiliently biased from the resiliency of the plastic material from which said mounting structure is molded.

9. A sliding door assembly according to claim 8, wherein said door panel assembly comprises a door panel, vertical side frame members on opposite sides of said door panel, an upper horizontal frame member along a top of said door panel, and a lower horizontal frame member along a bottom of said door panel, said connecting portions of said top guides including a downwardly extending side frame engaging portion constructed and arranged to be engaged in an opened upper end of an associated one of said vertical side frame members and a downwardly extending upper horizontal frame engaging portion constructed and arranged to be engaged in a slot within said upper horizontal frame member.

10. A sliding door assembly according to claim 9, wherein said connecting portions of each of said top guides include laterally extending tab portions constructed and arranged to engage slots in said associated vertical side frame members.

11. A sliding door assembly according to claim 10, wherein said connecting portions of each of said top guides include recesses for receiving fasteners, and wherein said laterally extending tab portions can be broken away from said mounting structure.

* * * * *